US006769904B1

(12) United States Patent
Iverson

(10) Patent No.: US 6,769,904 B1
(45) Date of Patent: Aug. 3, 2004

(54) CANDLE SNUFFER AND METHOD OF USE

(76) Inventor: Shane Iverson, P.O. Box 2155, Clackamas, OR (US) 97015

( * ) Notice: Subject to any disclaimer, the term of this patent is extended or adjusted under 35 U.S.C. 154(b) by 0 days.

(21) Appl. No.: 10/123,605

(22) Filed: Apr. 15, 2002

(51) Int. Cl.[7] ..... F23Q 25/00
(52) U.S. Cl. ..... 431/144; 431/145
(58) Field of Search ..... 431/33–35, 144, 431/145

(56) References Cited

U.S. PATENT DOCUMENTS

| | | | | | |
|---|---|---|---|---|---|
| D19,504 | S | * | 12/1889 | Cox et al. | D7/685 |
| 940,832 | A | * | 11/1909 | Swoger | 65/52 |
| D140,240 | S | * | 2/1945 | Martinelli | D7/685 |
| 4,441,746 | A | * | 4/1984 | Corboy, Jr. | 294/24 |
| 4,711,482 | A | * | 12/1987 | Brown et al. | 294/19.1 |
| 5,282,737 | A | * | 2/1994 | Ray | 431/2 |
| 5,820,360 | A | | 10/1998 | Callahan | |
| D406,409 | S | * | 3/1999 | Rubino | D29/127 |
| 5,971,081 | A | * | 10/1999 | Stewart | 169/54 |
| 6,298,922 | B1 | * | 10/2001 | Stewart | 169/46 |
| D453,862 | S | * | 2/2002 | Cormier et al. | D29/127 |
| 6,435,858 | B1 | * | 8/2002 | Cormier et al. | 431/120 |

* cited by examiner

*Primary Examiner*—Ira S. Lazarus
*Assistant Examiner*—James G Barrow
(74) *Attorney, Agent, or Firm*—Klarquist Sparkman, LLP

(57) ABSTRACT

A candle snuffer for extinguishing candle flames and for display as a decorative piece is disclosed. In an exemplary embodiment, the candle snuffer includes an elongate handle and first and second snuffing members coupled to the handle. A user-operable actuator is operatively connected to the first and second snuffing members and is operable to bring the first and second snuffing members into snuffing contact with each other to extinguish a candle flame positioned between the snuffing members. The handle and actuator may be configured to resemble parts of a plant, and the snuffing members may be configured to resemble the wings of a butterfly to permit display of the candle snuffer as a decorative piece. Also disclosed is a holder for supporting the candle snuffer in an upright position. The holder in a disclosed embodiment is configured to resemble a flowerpot to complement the plant/butterfly shape of the candle snuffer.

28 Claims, 3 Drawing Sheets

CANDLE SNUFFER AND METHOD OF USE

FIELD

The present invention concerns apparatus for snuffing candles.

BACKGROUND

Prior candle snuffers utilize some means for smothering a candle flame, either by capping or covering the end of the wick with a bell-shaped snuffer or flame extinguisher, or by pinching the wick itself between two surfaces. In each case, oxygen is excluded from the wick for a sufficient period of time or sufficient heat is withdrawn from the flame to extinguish the flame.

Candle snuffers that operate by pinching the wick are advantageous in that they minimize smoking of the wick when the candle flame is extinguished. However, such candle snuffers typically are not aesthetically pleasing and cannot be displayed as decorative pieces when not being used to extinguish candle flames.

One problem common to most types of candle snuffers is that accumulated hot wax and/or soot on the snuffer can be transferred to the table or other resting surface on which the snuffer is placed after being used to extinguish a candle flame. Consequently, the hot wax and/or soot can damage the table or resting surface on which the snuffer is placed.

Accordingly, there exists a need for new and improved apparatus for extinguishing candle flames and methods for their use.

SUMMARY

The present disclosure concerns a candle snuffer that is useful for extinguishing candle flames and for display as a decorative piece.

More specifically, and according to one representative embodiment, an apparatus for extinguishing a candle flame includes an elongate handle and first and second snuffing members coupled to the handle. A user-operable actuator is operatively connected to the first and second snuffing members and is operable to bring the first and second snuffing members into snuffing contact with each other to extinguish or snuff a candle flame positioned between the snuffing members. A biasing element (e.g., a compression spring), which extends through a portion of the handle, is configured to hold the first and second snuffing members normally separated from each other when the actuator is not being actuated by a user.

In particular embodiments, the first and second snuffing members are shaped to resemble the wings of an animal, such as a butterfly, a bee, or a bird, to allow display of the apparatus as a decorative piece when the apparatus is not being used to extinguish a candle flame. In addition, the handle and actuator may be configured to resemble parts of a plant so as to complement the shape of the snuffing members.

The apparatus also may include a holder or support for placing on a support surface, with the holder being configured to support the handle such that the snuffing members do not contact the support surface. Desirably, the holder is configured to support the handle in a vertically upright position. The holder in a disclosed embodiment is configured to resemble a flowerpot.

In a disclosed embodiment, the handle is formed with an actuator-receiving portion, and the actuator is slidably received in the actuator-receiving portion. The actuator is slidable longitudinally relative to the handle between a first position and a second position. Whenever the actuator is slid to the first position, the snuffing members are caused to separate from each other, and whenever the actuator is slid to the second position, the snuffing members are brought into snuffing contact with each other for extinguishing a candle flame. In addition, the biasing element in this embodiment is disposed in the actuator-receiving portion and is coupled to the actuator such that the actuator is normally biased to the first position for keeping the snuffing members separated from each other when the actuator is not being actuated by a user.

According to another representative embodiment, an apparatus for extinguishing a candle flame includes an elongate handle, first and second snuffers coupled to the handle, and a sliding member coupled to the first and second snuffers. The sliding member, which is positioned in a generally coaxial relationship with the handle, is slidable relative to the handle between a first position and a second position such that when the sliding member is in the first position, the snuffers are separated from each other and when the sliding member is in the second position, the snuffers are in snuffing contact with each other for extinguishing a candle flame. The apparatus also may include a biasing mechanism configured to urge the sliding member to the first position for holding the snuffers normally separated from each other.

According to yet another representative embodiment, an apparatus for extinguishing candle flames and for display upon a support surface includes an elongate handle having a lower portion and an upper portion. A flame extinguisher is coupled to the upper portion of the handle. The apparatus also includes a support for receiving the lower portion of the handle and supporting the handle in a generally vertically upright position such that the flame extinguisher does not contact the support surface.

According to still another representative embodiment, an apparatus for extinguishing candle flames and for display includes a handle and first and second snuffing members coupled to the handle. The snuffing members are operable to extinguish a lit candle wick whenever the snuffing members are brought into snuffing contact with each other about the lit candle wick. In addition, each snuffing member is in the shape of a wing of an animal, and the handle is in the shape of a plant so as to allow display of the apparatus as a decorative piece when the apparatus is not being used to extinguish a candle flame. The apparatus also may include a support for displaying the apparatus in an upright position when the apparatus is not being used to extinguish a candle flame. The support may be shaped to resemble a flowerpot to complement the shape of the handle and the snuffing members.

A method of using a candle snuffer according to one embodiment includes snuffing a candle flame with the candle snuffer. After extinguishing the candle flame, the candle snuffer is placed in a holder such that the candle snuffer is supported in a generally upright position for displaying the candle snuffer.

These and other features of the invention will be more fully appreciated when the following detailed description of the invention is read in conjunction with the accompanying drawings.

DETAILED DESCRIPTION

Figures 1, 2A:
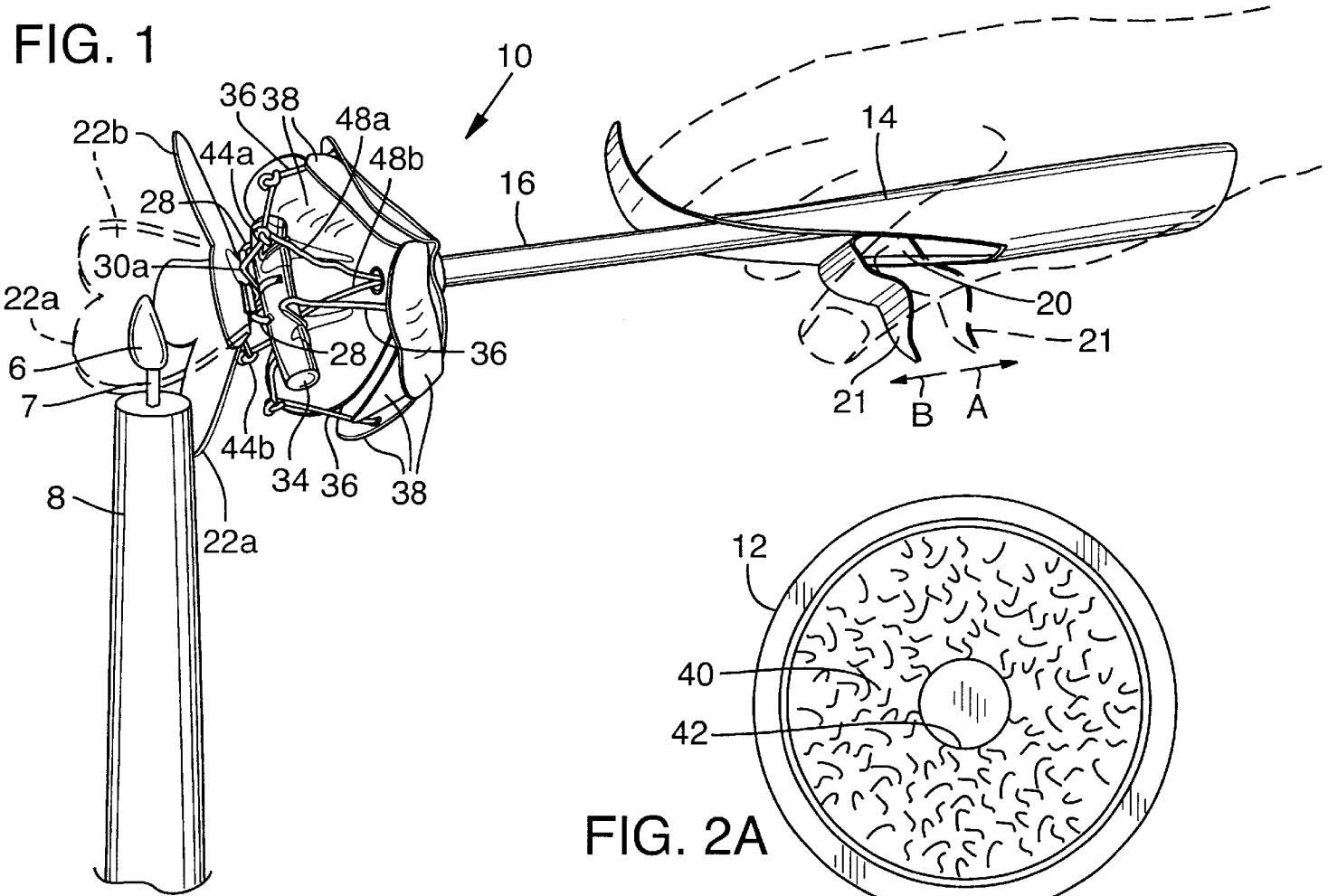
FIG. 1 is a perspective view of a candle snuffer according to one embodiment being used to extinguish a candle flame.
FIG. 2A is a top plan view of the holder of FIG. 2.
Figure 2:
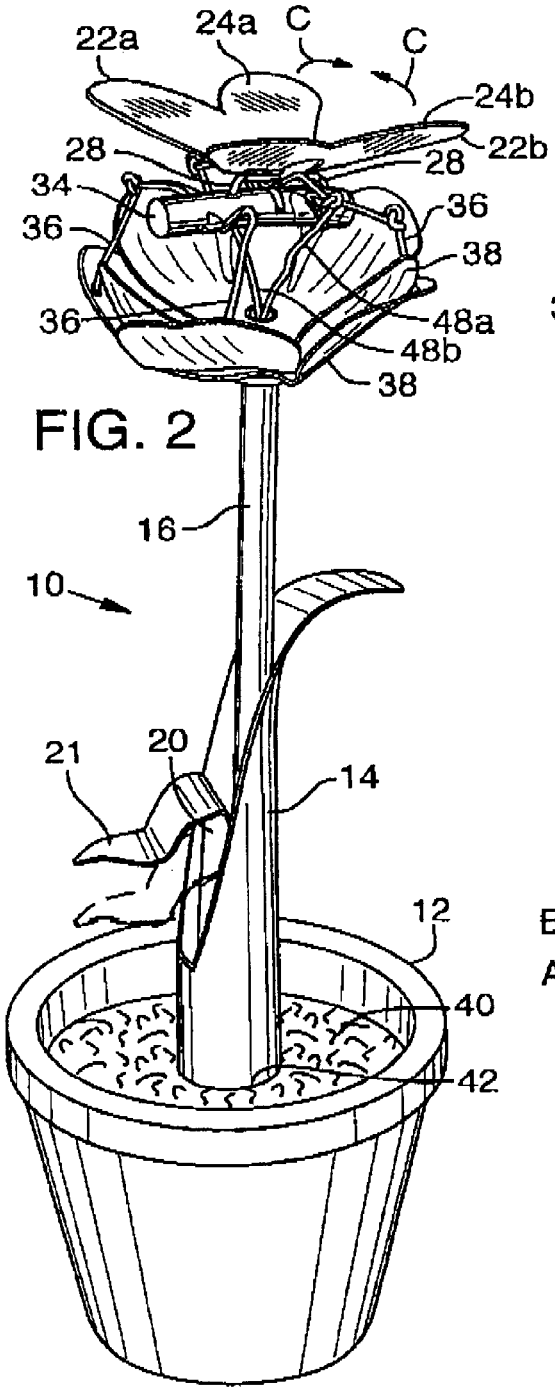
FIG. 2 is perspective view of the candle snuffer of FIG. 1 placed in a holder shaped to resemble a flowerpot.

Referring initially to FIG. 1, there is shown one embodiment of a candle snuffer, indicated generally at 10, being used to extinguish a flame 6 on the wick 7 of a candle 8. As shown in FIG. 2, when the candle snuffer 10 is not being used to extinguish a candle flame, it may be placed in a holder or support 12 for supporting the candle snuffer 10 in a generally upright position.

Figure 3:
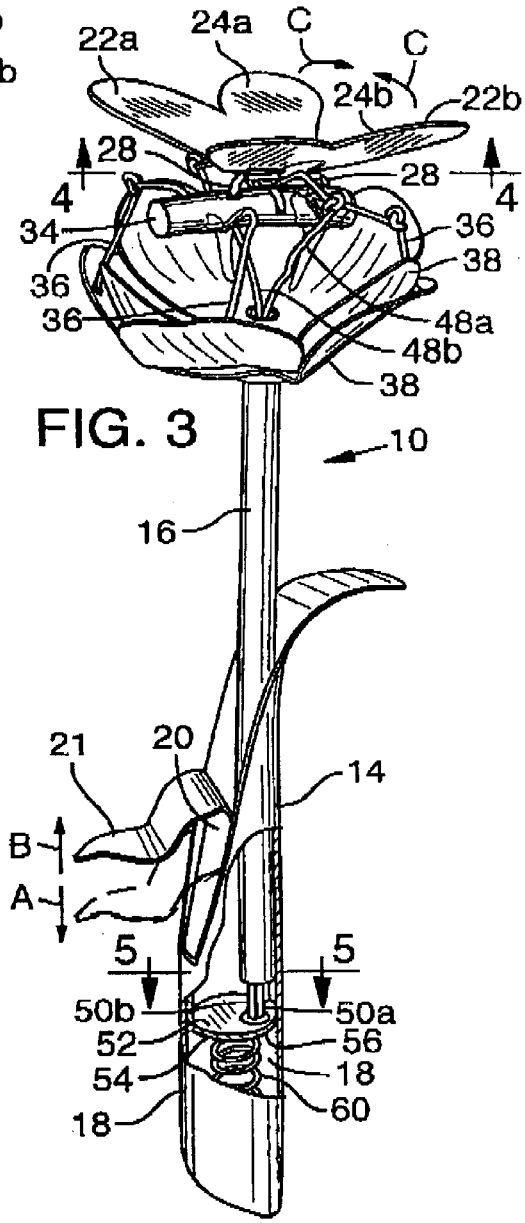
FIG. 3 is another perspective view of the candle snuffer of FIG. I with a portion of the handle broken away to reveal the inside of the handle.
Figure 6:
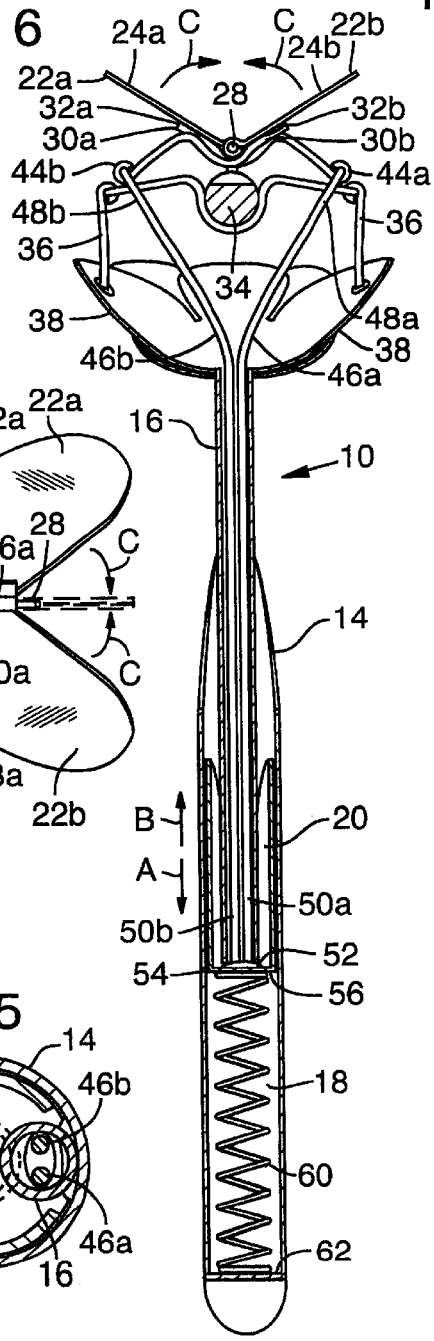
FIG. 6 is a longitudinal cross-sectional view of the candle snuffer of FIG. 1 showing the snuffing members separated from each other.
Figure 7:
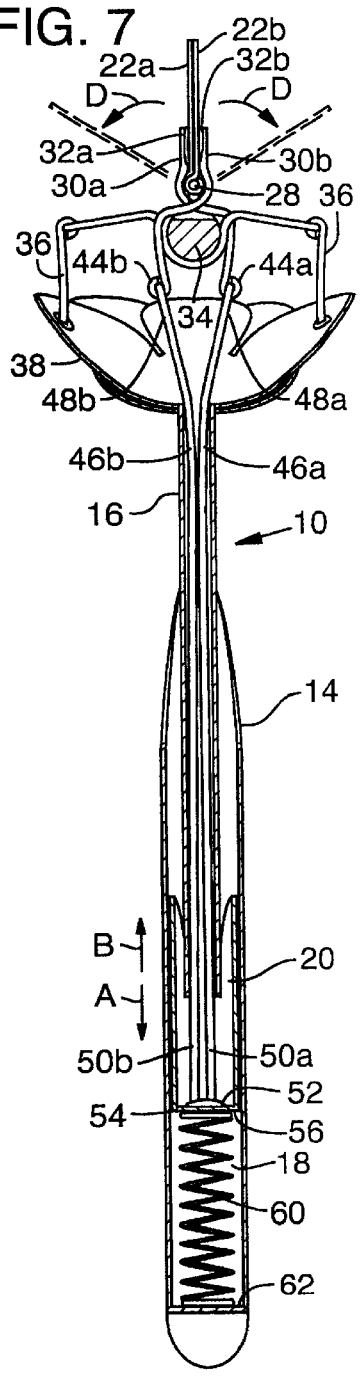
FIG. 7 is a view similar to FIG. 6 except showing the snuffing members in snuffing contact with each other.
Figure 5:
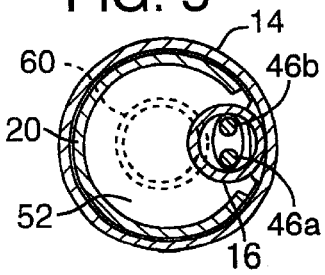
FIG. 5 is an enlarged cross-sectional view taken generally along line 5—5 of FIG. 3.

Referring to FIGS. 1, 3, 6 and 7, the candle snuffer 10 in the illustrated configuration comprises an elongate hand-engageable portion, or handle, 14. The inside of the handle 14 forms an actuator-receiving space 18. A user-operable actuator 20 (also referred to herein as a "sliding member") is slidably disposed in the actuator-receiving space 18 (FIGS. 3, 6, and 7). As best shown in FIG. 5, the actuator 20 is positioned in a coaxial relationship with the handle 14. The actuator 20 is operable for sliding movement relative to the handle 14 along the longitudinal axis of the handle 14. A thumb, or finger, -engageable portion 21 of the actuator 20 extends outwardly from the actuator-receiving space 18 for operation of the candle snuffer 10 by a user (FIGS. 1, 2, and 3).

Extending upwardly from the handle 14 is an elongate tube or hollow shaft 16, which is affixed to the inside surface of the handle 14 in a conventional manner (e.g., by welding or soldering or with an adhesive or a mechanical fastener) (FIGS. 3 and 5).

The candle snuffer 10 includes a flame extinguisher for extinguishing or snuffing a candle flame. In the illustrated embodiment, for example, the flame extinguisher comprises first and second snuffing members 22*a* and 22*b*, respectively (also referred to herein as "snuffers"). Each snuffing member 22*a*, 22*b* has a respective snuffing surface 24*a*, 24*b*, respectively. The first and second snuffing members 22*a*, 22*b* are pivotably coupled to each other about a pivot pin 28 to allow their respective snuffing surfaces 24*a* and 24*b* to be brought into snuffing contact with each other for extinguishing a candle flame.

As used herein, to bring the snuffing surfaces into "snuffing contact" with each other means to bring the snuffing surfaces within sufficient proximity to each other to cause a flame positioned between the snuffing surfaces to become extinguished. "Snuffing contact" may include, but is not limited to, actual physical contact between the snuffing surfaces. The snuffing surfaces 24*a*, 24*b* in the illustrated embodiment are substantially flat so that they register flush with each other whenever the snuffing surfaces 24*a*, 24*b* are brought into snuffing contact with each other (as shown in FIG. 7).

Flame extinguishers other than the illustrated snuffing members 22*a*, 22*b* also may be used. For example, in an alternative embodiment, the candle snuffer 10 may include a bell-shaped flame extinguisher, as generally known in the art.

As shown in FIGS. 1, 2, 3, 6 and 7, the handle 14, the shaft 16, and the actuator 20 in the illustrated embodiment are configured to resemble parts of a plant or flower to allow display of the candle snuffer 10 as a decorative piece when the candle snuffer 10 is not being used to extinguish a candle flame. Mounted to the distal end of the shaft 16, which is configured to resemble a portion of the stem of the plant, are decorative petal-shaped members 38. In addition, the snuffing members 22*a*, 22*b* in the illustrated configuration are shaped to resemble the wings of a butterfly. The snuffing members 22*a*, 22*b* are mounted on top of a support member 34, which is configured to resemble the body of the butterfly. Wire members 36, which are configured to resemble the legs of the butterfly, support member 34 on top of the petal-shaped members 38. Wire members 36 may be affixed to the petal-shaped members 38 in a conventional manner.

The illustrated holder 12, as shown in FIG. 2, is in the form of a flowerpot to complement the overall shape of the candle snuffer 10. As shown in FIG. 2A, a handle-support portion 40 is disposed inside the holder 12. The handle-support portion 40 is formed with a concentrically disposed opening 42 dimensioned to receive handle 14 of the candle snuffer 10. Thus, whenever the candle snuffer 10 is not being used to extinguish a candle flame, the handle 14 can be inserted into the opening 42 for supporting the candle snuffer 10 in a vertically upright position for display as a decorative piece (as shown in FIG. 2). The holder 12 also serves to support the candle snuffer 10 such that the snuffing members 22*a*, 22*b* do not contact the table (not shown) or other support surface on which the holder 12 is placed. In this manner, transfer of hot wax and/or soot from the snuffing members 22*a*, 22*b* to the table or other support surface is avoided.

In the illustrated embodiment, the handle 14 is completely removable from the holder 12, however, this is not a requirement. Accordingly, in alternative embodiments, the handle 14 can be attached to the holder 12.

The various components of the candle snuffer 10 and/or the holder 12 can be configured to resemble other decorative forms. For example, the snuffing members 22*a*, 22*b* can be shaped to resemble the wings of a bee or a bird, rather than the wings of a butterfly. In other embodiments, the snuffing members 22*a*, 22*b* can be shaped to resemble leaves of a plant. Still alternatively, the various components of the candle snuffer 10 and/or the holder 12 can be shaped such that they do not resemble any particular decorative form.

Figure 4:
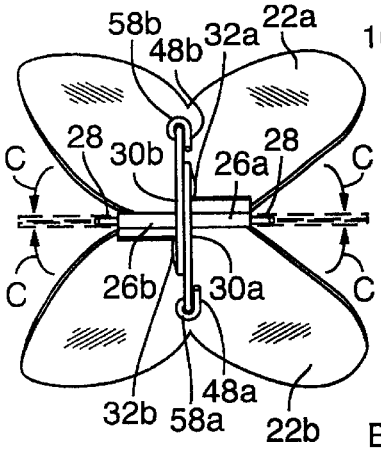
FIG. 4 is a bottom view of snuffing members of the candle snuffer taken along line 4—4 of FIG. 3.

Referring to FIG. 4, there is shown a bottom view of the snuffing members 22*a*, 22*b*. As shown, each snuffing member 22*a*, 22*b* in the illustrated configuration is formed with a respective knuckle, or sleeve, 26*a* and 26*b*. The pivot pin 28 extends through each knuckle 26*a*, 26*b* so as to permit pivoting of the snuffing members 22*a*, 22*b* about the pivot pin 28 for bringing the snuffing surfaces 24*a*, 24*b* into snuffing contact with each other. As best shown in FIG. 3, the pivot pin 28 has downwardly extending end portions that are affixed in a conventional manner to the support member 34.

Referring to FIGS. 4 and 6, a first transverse wire or cord 30*a* is affixed in a conventional manner to the bottom of the first snuffing member 22*a*, as indicated at 32*a*. The first transverse wire 30*a* extends from first snuffing member 22*a* to a region underlying the second snuffing member 22*b*, and then terminates in a loop 44*a* below the second snuffing member 22*b* (as best shown in FIG. 6). Similarly, a second transverse wire or cord 30*b* is affixed to the bottom of the second snuffing member 22*b*, as indicated at 32*b*. The second transverse wire 30*b* extends parallel to the first transverse wire 30*a* from the second snuffing member 22*b* to a region underlying the first snuffing member 22*a*, and then terminates in a loop 44*b* below the first snuffing member 22*a* (as best shown in FIG. 6).

Extending through the shaft 16 are first and second longitudinal wires or cords 46*a* and 46*b*, respectively, which couple the first and second transverse wires 30*a*, 30*b*, respectively, to the actuator 20 (FIGS. 6 and 7). The first longitudinal wire 46*a* includes a distal end portion 48*a* and a proximal end portion 50*a*. The distal end portion 48*a* terminates in a loop 58*a* (FIG. 4) which is linked with the loop 44*a* of the first transverse wire 30*a*. The proximal end portion 50*a* is connected in a conventional manner to the upper surface 52 of a lower wall 54 of actuator 20. Similarly, the second longitudinal wire 46*b* includes a distal end portion 48*b* and a proximal end portion 50*b*. The distal end portion 48*b* terminates in a loop 58*b* (FIG. 4) which is linked with the loop 44*b* of the second transverse wire 30*b*. The proximal end portion 50*b* is connected in a conventional manner to the upper surface 52 of lower wall 54.

The longitudinal wires 46*a*, 46*b* translate longitudinal movement of the actuator 20 relative to the handle 14 into corresponding pivoting movement of the snuffing members 22*a*, 22*b* about pivot pin 28. For example, referring to FIGS. 6 and 7, longitudinal movement of the actuator 20 in the direction indicated by arrow A causes the snuffing members 22*a*, 22*b* to move toward each other, as indicated by arrows C in FIG. 6, until the snuffing members 22*a*, 22*b* are brought into snuffing contact with each other (FIG. 7). Conversely, longitudinal movement of the actuator 20 in the opposite direction (in the direction of arrow B) causes the snuffing members 22*a*, 22*b* to move away from each other (as indicated by arrows D in FIG. 7).

The candle snuffer 10 desirably includes a biasing element or biasing mechanism, such as the illustrated compression spring 60, for normally holding the snuffing members 22*a*, 22*b* separated from each other (as shown in FIG. 6). As best shown in FIGS. 6 and 7, the compression spring 60 is disposed in the actuator-receiving space 18 and extends between the lower surface 56 of lower wall 54 of actuator 20 and the bottom inside surface 62 of the handle 14. The compression spring 60 provides a biasing force for urging the actuator 20 in the B direction for keeping the snuffing members 22*a*, 22*b* normally separated from each other.

To operate the candle snuffer 10, the snuffing members 22*a*, 22*b* are positioned on either side of a lit candle wick 7 (as shown in FIG. 1). The actuator 20 is then moved in the A direction, such as by depressing the thumb-engageable portion 21, against the bias of the compression spring 60 to cause the snuffing members 22*a*, 22*b* to come into snuffing contact with each other about the candle wick, thereby extinguishing the flame. After using the candle snuffer 10 to extinguish the flame, the candle snuffer 10 may be placed in the holder 12 for display as a decorative piece.

The present invention has been described with respect to particular embodiments and modes of action for illustrated purposes only. The present invention may be subject to many modifications and changes without departing from the spirit or essential characteristics thereof. I therefore claim as my invention all such modifications as come within the scope of the following claims.

I claim:

1. An apparatus for extinguishing a candle flame, comprising:

an elongate handle;

first and second snuffing members coupled to the handle;

a user-operable actuator operatively connected to the first and second snuffing members and operable to bring the first and second snuffing members into snuffing contact with each other to extinguish a candle flame;

a biasing element extending through a portion of the handle, the biasing element configured to hold the first and second snuffing members normally separated from each other whenever the actuator is not actuated by a user; and wherein the biasing element is a compression spring.

2. The apparatus of claim 1, wherein the actuator is slidable relative to the handle between a first position and a second position, wherein when the actuator is moved to the first position, the snuffing members are caused to separate from each other and when the actuator is moved to the second position, the snuffing members are brought into snuffing contact with each other.

3. The apparatus of claim 2, wherein the biasing element urges the actuator to the first position to normally hold the snuffing members separated from each other.

4. The apparatus of claim 2, wherein the handle is formed with an actuator-receiving portion, and the actuator is slidably received in the actuator-receiving portion and is longitudinally slidable relative to the handle between the first position and the second position.

5. The apparatus of claim 4, wherein the biasing element is disposed in the actuator-receiving portion and is coupled to the actuator such that the actuator is normally biased to the first position.

6. The apparatus of claim 1, wherein the first and second snuffing members are shaped to resemble wings of an animal.

7. The apparatus of claim 6, wherein the first and second snuffing members are shaped to resemble wings of a butterfly.

8. The apparatus of claim 1, further comprising a holder for placing on a support surface, the holder configured to receive the handle and support the handle such that the snuffing members do not contact the support surface.

9. The apparatus of claim 8, wherein the holder is configured to support the handle in a generally upright position.

10. The apparatus of claim 8, wherein the holder is configured to resemble a flowerpot.

11. The apparatus of claim 1, wherein the handle and actuator are configured to resemble parts of a plant.

12. An apparatus for extinguishing a candle flame, comprising:

an elongate handle;

first and second snuffers coupled to the handle; and a sliding member coupled to the first and second snuffers, the sliding member being slidable relative to the handle in a coaxial relationship with the handle between a first position and a second position, wherein when the sliding member is moved to the first position, the snuffers are caused to separate from each other and when the sliding member is moved to the second position, the snuffers are brought into snuffing contact with each other for extinguishing a candle flame.

13. The apparatus of claim 12, further comprising a biasing mechanism configured to urge the sliding member to the first position for holding the snuffers normally separated from each other.

14. The apparatus of claim 13, wherein the biasing mechanism provides a biasing force against a bottom surface of the sliding member for urging the sliding member to the first position.

15. The apparatus of claim 13, wherein the biasing mechanism is a compression spring.

16. The apparatus of claim 12, wherein the sliding member is slidably received inside the handle.

17. The apparatus of claim 16, wherein the sliding member comprises a thumb or finger-engageable portion extending outwardly from the handle.

18. The apparatus of claim 12, further comprising a holder for supporting the handle in a generally upright position.

19. The apparatus of claim 18, wherein the handle is completely detachable from the holder.

20. The apparatus of claim 12, wherein the sliding member is positioned in a generally coaxial relationship with the handle and is slidable longitudinally with respect to the handle.

21. An apparatus for extinguishing a candle flame, comprising:

an elongate handle;

first and second snuffers coupled to the handle; and a sliding member coupled to the first and second snuffers, the sliding member being slidable relative to the handle in a generally coaxial relationship with the handle between a first position and a second position, wherein when the sliding member is moved to the first position, the snuffers are caused to separate from each other and when the sliding member is moved to the second position, the snuffers are brought into snuffing contact with each other for extinguishing a candle flame;

wherein the biasing mechanism provides a biasing force against a bottom surface of the sliding member for urging the sliding member to the first position.

22. An apparatus for extinguishing a candle flame, comprising:

an elongate handle;

first and second snuffers coupled to the handle; and a sliding member coupled to the first and second snuffers, the sliding member being slidable relative to the handle in a generally coaxial relationship with the handle between a first position and a second position, wherein when the sliding member is moved to the first position, the snuffers are caused to separate from each other and when the sliding member is moved to the second position, the snuffers are brought into snuffing contact with each other for extinguishing a candle flame;

wherein the biasing mechanism is a compression spring.

23. An apparatus for extinguishing a candle flame, comprising:

an elongate handle;

first and second snuffers coupled to the handle; and a sliding member coupled to the first and second snuffers, the sliding member being slidable relative to the handle in a generally coaxial relationship with the handle between a first position and a second position, wherein when the sliding member is moved to the first position, the snuffers are caused to separate from each other and when the sliding member is moved to the second position, the snuffers are brought into snuffing contact with each other for extinguishing a candle flame;

wherein the sliding member is slidably received inside the handle.

24. The apparatus of claim 23, wherein the sliding member comprises a thumb or finger-engageable portion extending outwardly from the handle.

25. An apparatus for extinguishing a candle flame, comprising:

an elongate handle;

first and second snuffers coupled to the handle;

a sliding member coupled to the first and second snuffers, the sliding member being slidable relative to the handle in a generally coaxial relationship with the handle between a first position and a second position, wherein when the sliding member is moved to the first position, the snuffers are caused to separate from each other and when the sliding member is moved to the second position, the snuffers are brought into snuffing contact with each other for extinguishing a candle flame; and a holder for supporting the handle in a generally upright position.

26. The apparatus of claim 25, wherein the handle is completely detachable from the holder.

27. An apparatus for extinguishing a candle flame, comprising:

an elongate handle;

first and second snuffing members coupled to the handle;

a user-operable actuator operatively connected to the first and second snuffing members and operable to bring the first and second snuffing members into snuffing contact with each other to extinguish a candle flame;

a biasing element extending through a portion of the handle, the biasing element configured to hold the first and second snuffing members normally separated from each other whenever the actuator is not actuated by a user;

wherein the actuator is slidable relative to the handle between a first position and a second position, wherein when the actuator is moved to the first position, the snuffing members are caused to separate from each other and when the actuator is moved to the second position, the snuffing members are brought into snuffing contact with each other;

wherein the handle is formed with an actuator-receiving portion, and the actuator is slidably received in the actuator-receiving portion and is longitudinally slidable relative to the handle between the first position and the second position; and wherein the biasing element is disposed in the actuator-receiving portion and is coupled to the actuator such that the actuator is normally biased to the first position.

28. The apparatus of claim 27, further comprising a holder for placing on a support surface, the holder configured to receive the handle and support the handle such that the snuffing members do not contact the support surface.

* * * * *